US007178375B2

(12) United States Patent
Badour

(10) Patent No.: US 7,178,375 B2
(45) Date of Patent: Feb. 20, 2007

(54) APPARATUS AND METHOD FOR STAMPING AND DEBURRING CLUTCH DISCS

(75) Inventor: James P. Badour, Essexville, MI (US)

(73) Assignee: Means Industries, Inc., Saginaw, MI (US)

( * ) Notice: Subject to any disclaimer, the term of this patent is extended or adjusted under 35 U.S.C. 154(b) by 93 days.

(21) Appl. No.: 10/973,680

(22) Filed: Oct. 26, 2004

(65) Prior Publication Data

US 2006/0086171 A1 Apr. 27, 2006

(51) Int. Cl.
*B21D 28/00* (2006.01)
*B21D 53/00* (2006.01)

(52) U.S. Cl. ..... 72/336; 29/893.33; 192/70.14

(58) Field of Classification Search ..... 72/335, 72/336; 29/893.36, 893.33; 192/70.14, 192/107 R
See application file for complete search history.

(56) References Cited

U.S. PATENT DOCUMENTS

| | | | | |
|---|---|---|---|---|
| 3,307,669 | A * | 3/1967 | Klinkenberg | 192/84.96 |
| 4,672,729 | A * | 6/1987 | Hoguchi et al. | 29/893.34 |
| 5,737,956 | A * | 4/1998 | Takahashi et al. | 72/336 |
| 5,779,018 | A * | 7/1998 | Hofmann et al. | 192/70.14 |
| 6,212,930 | B1 | 4/2001 | Skrabs et al. | |
| 6,223,578 | B1 * | 5/2001 | Kamijo | 72/336 |

* cited by examiner

*Primary Examiner*—Daniel C. Crane
(74) *Attorney, Agent, or Firm*—Brooks Kushman P.C.

(57) ABSTRACT

Stamped and deburred clutch discs (20*a*, 20*b*) are provided by progressive stamping apparatus (46) whose method of use performs a two step stamping of the clutch disc blank and a third deburring stamping step that removes burrs on opposite axial faces by contact in opposite directions.

18 Claims, 3 Drawing Sheets

APPARATUS AND METHOD FOR STAMPING AND DEBURRING CLUTCH DISCS

BACKGROUND OF THE INVENTION

1. Field of the Invention

This invention relates to apparatus and a method for progressively stamping and deburring a metallic clutch disc from a sheet metal strip and also relates to the resultant clutch disc.

2. Background Art

Clutch discs are conventionally stamped from a sheet metal strip and have an annular shape with splines on either an outer or inner extremity of the stamped clutch disc. Burrs that form on the clutch discs during such stamping are conventionally removed by a vibratory process wherein the stamped clutch discs are placed within a media of steel or ceramic with a liquid and then vibrated for a sufficient time to remove the burrs.

U.S. Pat. No. 6,212,930 discloses clutch plates whose annular shape is stamped by a single stamping step and wherein a further stamping step in a single direction removes burrs which are on the same axial face as each other at the inner and outer extremities.

SUMMARY OF THE INVENTION

One object of the present invention is to provide improved apparatus for progressively stamping a metallic clutch disc from a sheet metal strip.

In carrying out the above object, the apparatus for progressively stamping a metallic clutch disc from a sheet metal strip in accordance with the invention includes progressive stamping stations for stamping a blank of the metallic clutch disc from the sheet metal strip so as to have a generally annular shape extending around a central axis and including oppositely oriented axial faces and inner and outer extremities, with one of the extremities having splines forming a generally round shape about the central axis and including a first burr extending therefrom and from one of the axial faces in one axial direction along the central axis, and with the other extremity having a generally continuous round shape about the central axis and including a second burr extending therefrom and from the other axial face in the opposite axial direction as the first burr along the central axis. The apparatus also includes a deburring station including a deburring die set having an annular spline shaped deburring punch and a flat deburring die between which the clutch disc blank is positioned for relative movement of the deburring punch and the deburring die toward each other. The spline shaped deburring punch has a peripheral spline shaped deburring projection that flattens the first burr extending from the one spine shaped extremity and the one axial face. The flat deburring die flattens the second burr extending from the other extremity and the other axial face.

The progressive stamping stations include: a first forming die set including a generally round forming die and a forming punch for removing a round blank from the clutch disc being stamped to provide the inner extremity of the clutch disc blank. A second forming die set of the stamping stations include a forming die and a forming punch for separating the clutch disc blank from the sheet metal strip to provide a round outer extremity of the clutch disc blank. The forming die and forming punch of one of the forming die sets have annular spline formations for providing the extremity formed thereby with the splines.

In one embodiment of the apparatus, the forming punch and forming die of the first forming die set are round and form the inner extremity of the clutch disc blank with the generally continuous round shape. This embodiment has the forming punch and forming die of the second die set provided with the annular spline formations for providing the outer extremity of the clutch blank with the splines.

Another embodiment of the apparatus has the forming punch and forming die of the first forming die set provided with the annular spline formations for providing the inner extremity of the clutch disc blank with the splines. This embodiment has the forming punch and forming die of the second die set provided with round shape and stamp the outer extremity of the clutch blank with the generally continuous round shape.

The peripheral spline shaped deburring projection of the deburring punch projects a sufficient extent to both flatten the first burr and decrease the thickness between the axial faces with an annular spline formation. More specifically, the peripheral spline formation has a thickness between about 5 and 20% thinner than the thickness between the oppositely facing axial faces of the clutch disc blank before the deburring. Also, the peripheral spline formation extends inwardly from the extremity thereof an amount in the range of 0.010 to 0.060 of an inch.

Another object of the present invention is to provide an improved method for progressively stamping a metallic clutch disc from a sheet metal strip.

In carrying out the immediately preceding object, the method for progressively stamping a metallic clutch disc from a sheet metal strip in accordance with the invention is performed by progressively stamping a blank of the metallic clutch disc from the sheet metal strip so as to have a generally annular shape extending around a central axis and including oppositely oriented axial faces and inner and outer extremities, with one of the extremities having splines forming a generally round shape about the central axis and including a first burr extending therefrom and from one of the axial faces in one axial direction along the central axis, and with the other extremity having a generally continuous round shape about the central axis and including a second burr extending therefrom and from the other axial face in the opposite axial direction as the first burr along the central axis. The clutch disc blank is then positioned at a deburring station within a deburring die set between an annular spline shaped deburring punch and a flat deburring die for relative movement of the deburring punch and the deburring die toward each other so a peripheral spline shaped deburring projection of the spline shaped deburring punch flattens the first burr extending from the one spline shaped extremity and the one axial face and forms a peripheral spline formation and so the flat deburring die flattens the second burr extending from the other extremity and the other axial face.

In performing the progressive stamping, a forming punch of a first forming die set is initially moved toward a forming die thereof to remove a round blank from the clutch disc being stamped to provide the inner extremity of the clutch disc blank. A forming punch of a second forming die set is then moved toward a forming die thereof to separate the clutch disc blank from the sheet metal strip. The forming punch and forming die of one of the die sets used have annular spline formations for providing the extremity formed thereby with the splines.

In one practice of the method, the forming punch and forming die of the first forming die set form the inner extremity of the clutch disc blank with the generally continuous round shape, and the forming punch and forming die of the second die set form the outer extremity of the clutch blank with the splines.

In another practice of the method, the forming punch and forming die of the first forming die set form the inner extremity of the clutch disc blank with the splines, and the forming punch and forming die of the second die set form the outer extremity of the clutch blank with the generally continuous round shape.

The spline shaped deburring punch and the flat deburring die of the deburring die set flatten the first burr and decrease the thickness between the axial faces at the peripheral spline formation. Furthermore, the spline shaped deburring punch and the flat deburring die of the deburring die set flatten the first burr and decrease the thickness between the axial faces at the peripheral spline formation with a thickness that is between about 5 and 20% thinner than the thickness between the rest of the oppositely facing axial faces of the clutch disc blank.

In addition, the spline shaped deburring punch and the flat deburring die of the deburring die set flatten the first burr and decrease the thickness between the axial faces with the peripheral spline formation extending inwardly from the extremity thereof an amount in the range of 0.010 to 0.060 of an inch.

The objects, features and advantages of the present invention are readily apparent from the following detailed description of the drawings when taken in connection with the description of the preferred embodiments.

DETAILED DESCRIPTION OF THE PREFERRED EMBODIMENTS

Figure 1A:
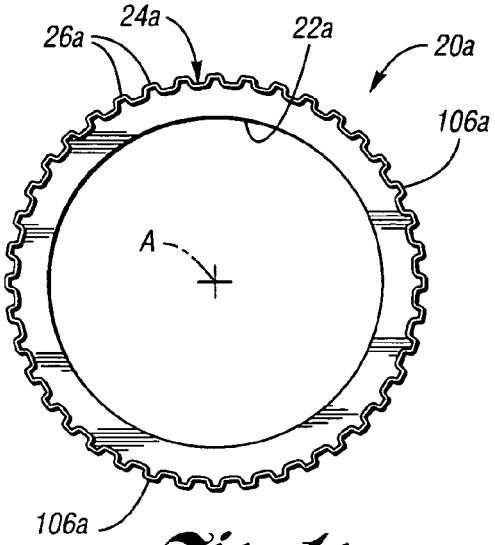
FIGS. 1*a* and 1*b* are plan views of two different embodiments of a stamped metallic clutch disc constructed by apparatus of the invention in accordance with the progressive stamping method of the invention, with the embodiment with FIG. 1*a* having splines at its outer extremity, and with the embodiment of FIG. 1*b* having splines at its inner extremity.
Figure 1B:
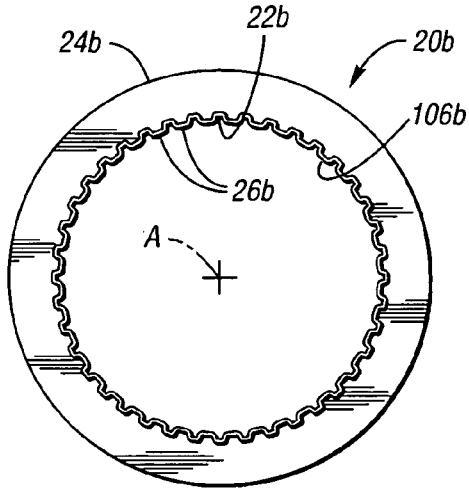

With reference to FIGS. 1*a* and 1*b*, two different embodiments of a stamped sheet metal clutch disc 20*a* and 20*b* are respectively illustrated. Each embodiment of the clutch disc 20*a*, 20*b* is stamped from sheet metal to have a generally annular shape extending about a central axis A as is hereinafter more fully described. In the embodiment of FIG. 1*a*, the clutch disc 20*a* has an inner extremity 22*a* of a generally continuous round shape and has an outer extremity 24*a* having splines 26*a* that project outwardly in a radial direction spaced circumferentially around the central axis A in a generally round shape. In the embodiment of FIG. 1*b*, the clutch disc 20*b* has an inner extremity 22*b* having splines 26*b* spaced around the central axis A to define a generally round shape with the splines extending radially inward, and the clutch disc 20*b* also has an outer extremity 24*b* of a generally continuous round shape extending about the central axis A. As is hereinafter more fully described, each of the clutch disc embodiments 20*a* and 20*b* has oppositely facing axial surfaces 28*a*, 30*a* and 28*b*, 30*b* extending between its inner and outer extremities 22*a*, 24*a* and 22*b*, 24*b*. FIGS. 3*a* and 3*b* and FIGS. 4*a* and 4*b* illustrate the manner in which stamping initially forms the inner and outer clutch disc blanks and subsequently is utilized to provide deburring as is hereinafter more fully described. The apparatus utilized to make the clutch disc, and the clutch disc stamping method of the invention will both be described in an integrated manner to facilitate an understanding of all aspects of the invention.

Figure 5:
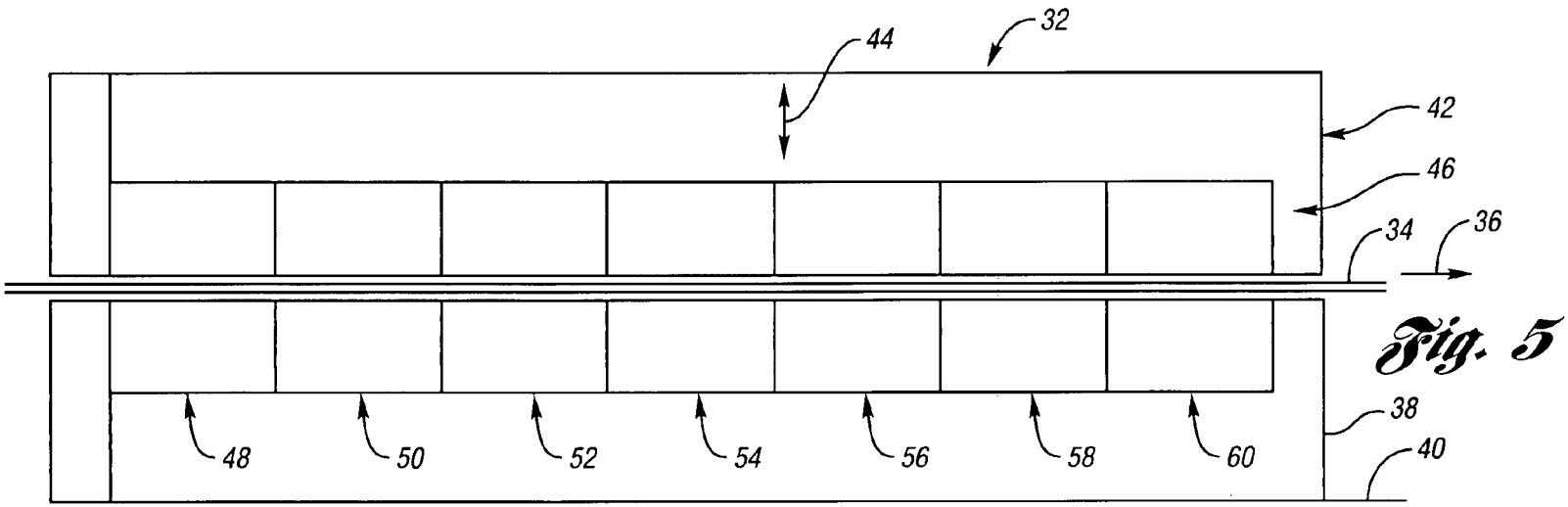
FIG. 5 is a side elevational view of a progressive stamping machine whose apparatus provides the clutch disc blank stamping and deburring stamping of each embodiment.

With reference to FIG. 5, a progressive stamping machine 32 is operable to perform progressive stamping of the clutch disc from a sheet metal strip 34 that moves from the left toward the right as indicated by arrow 36. The progressive stamping machine 32 includes a lower base 38 supported on the factory floor 40 and also includes an upper stamping head 42 that is moved vertically down and up to perform the stamping operation as shown by arrows 44. The progressive stamping machine 32 includes progressive stamping apparatus 46 for providing progressive stamping and deburring of the metallic clutch discs. This progressive stamping apparatus 46 includes progressive stamping stations which from the left toward the right include: an inner extremity stamping station 48, an idle station 50, an outer extremity stamping station 52, an idle station 54, a deburring stamping station 56, an idle station 58, and a delivery station 60 where the completed clutch discs are removed from the metal strip 34 for further assembly in a clutch for eventual use.

Figure 6A:
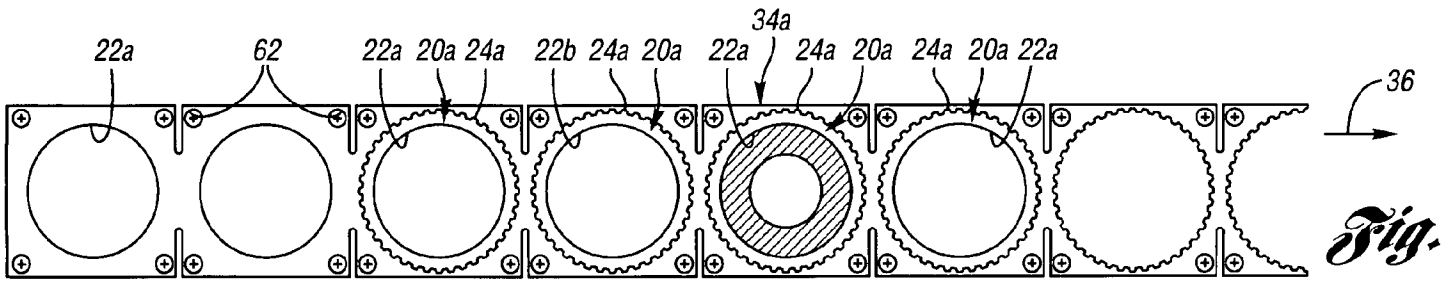
FIGS. 6*a* and 6*b* are plan views that respectively disclose the manner in which the two different embodiments of the clutch discs are stamped by the progressive stamping machine of FIG. 5.
Figure 6B:
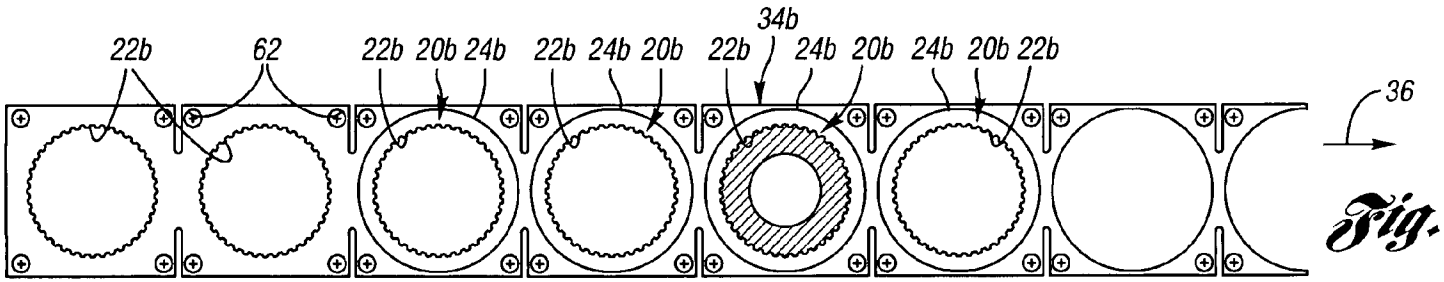

Progressive stamping machine shown in FIG. 5 is operable to perform stamping on a sheet metal strip 34*a* as shown in FIG. 6*a* or a sheet metal strip 34*b* as shown in FIG. 6*b* to respectively provide the clutch disc embodiments previously described in connection with FIGS. 1*a*–4*a* and 1*b*–4*b*. Each of these sheet metal strips includes guide holes 62 through which guide pins of the machine are cyclically inserted to insure proper alignment during the progressive stamping.

Figure 2A:
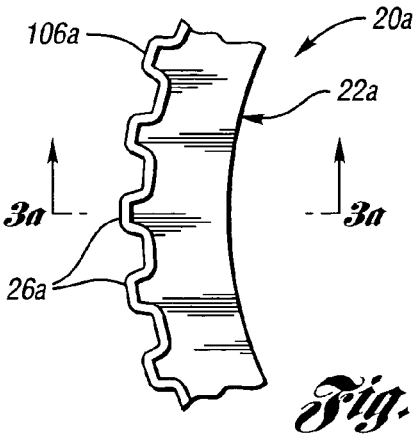
FIGS. 2*a* and 2*b* are respectively partial views of the clutch discs shown in FIGS. 1*a* and 1*b* but illustrated at an enlarged scale to better show a peripheral spline formation at the outer (FIG. 2*a*) and inner (FIG. 2*b*) extremities of the clutch disc.
Figure 2B:
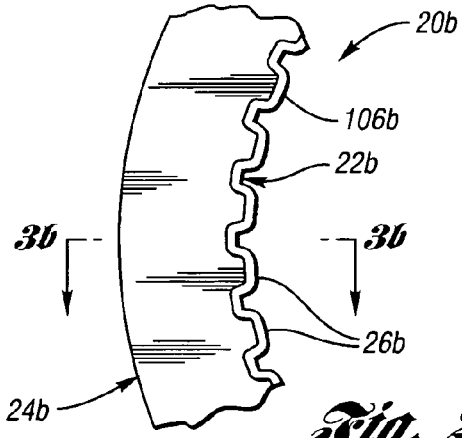
Figure 3A:
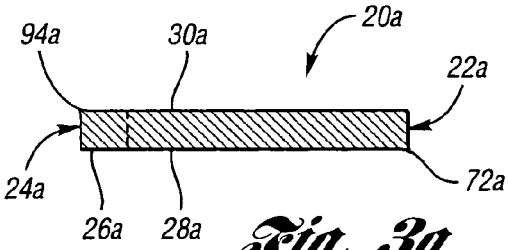
FIGS. 3*a* and 3*b* are respectively taken along the directions of lines 3*a*–3*a* and 3*b*–3*b* of FIGS. 2*a* and 2*b* but shown after stamping of their inner and outer extremities as clutch disc blanks which have oppositely directed burrs prior to a deburring stamping operation.
Figure 7A:
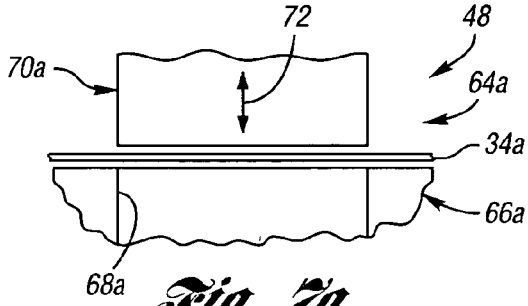
FIGS. 7*a* and 7*b* respectively illustrate the inner extremity stamping of the two clutch disc embodiments at an initial stamping station.
Figure 7B:
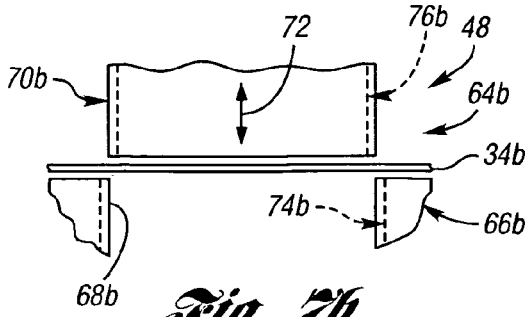

With reference to FIGS. 7*a* and 7*b*, the inner extremity stamping station 48 is provided with a forming die set 64*a* or 64*b* to perform the stamping of the inner extremity 22*a* or 22*b* (FIGS. 1*a* and 1*b*) of the metallic clutch disc. As shown in FIG. 7*a*, the die set 64*a* includes a lower forming die 66*a* having a round hole 68*a* and also includes an upper punch 70*a* of a round shape that is moved upwardly and downwardly as shown by arrow 72 to provide stamping of the sheet metal strip 34*a* to define the inner extremity 22*a* as shown in FIGS. 1*a*–3*a* and 6*a*. This stamping as shown in FIG. 3*a* results in a burr 72*a* that extends from the inner extremity 22*a* and axial face 28*a* in a downward direction along the central axis of the clutch disc. In the embodiment illustrated in FIG. 7*b*, the inner extremity forming die set 64*b* includes a lower forming die 66*b* having a round hole 68*b* that is provided with an annular spline formation 74*b*. Forming die set 64*b* also includes an upper generally round punch 70*b* that includes an annular spline formation 76*b* of a slightly smaller size than the spline formation 74*b* in the lower die 66*b*. Vertical movement of the upper punch 70*b* as shown by arrow 72 provides stamping of the sheet metal strip 34*b* to provide the splined inner extremity 22*b* shown in FIGS. 1*b*–3*b* and 6*b*. This stamping also provides the splined inner extremity 22*b* with a burr 72*b* that extends from the inner extremity 22*b* and the axial face 28*b* in a downward direction along the central axis of the clutch disc. Thus, both of the embodiments shown in FIGS. 3*a* and 3*b* have their burrs 72*a* and 72*b* extending in the same direction along the central axis, which is in downward direction as shown.

Figure 8A:
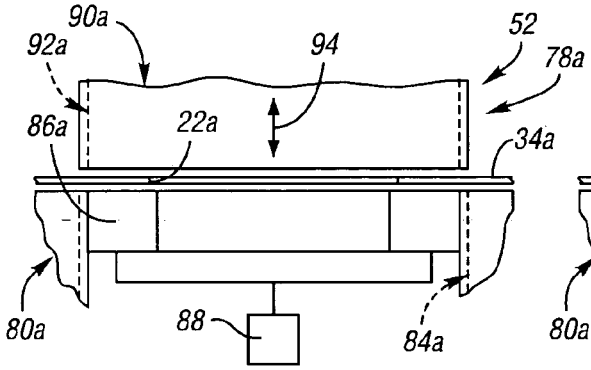
FIGS. 8*a* and 8*b* respectively illustrate the outer extremity stamping of the two clutch disc embodiments at an outer extremity stamping station.
Figure 8B:
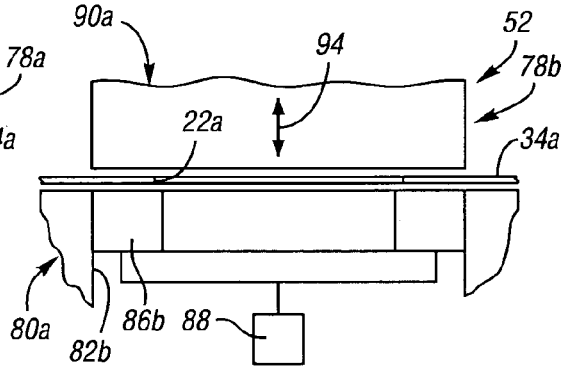

The outer extremity stamping station 52 is provided with a second forming die set 78*a* as shown in FIG. 8*a* and 78*b* as shown in FIG. 8*b* to provide stamping and forming of the outer extremity of the metallic clutch disc.

The second forming die set 78*a* shown in FIG. 8*a* has a lower die 80*a* including a generally round opening 82*a* that includes an annular spline formation 84*a*. This lower round opening 82*a* receives an externally splined insert 86*a* that is movable vertically within the round hole and supported against downward movement by a gas spring 88. The second forming die set 78*a* also includes a generally round upper punch 90*a* having an annular spline formation 92*a* that is slightly smaller than the splined formation 84*a* of the lower die round opening 82*a*. Vertical movement of the upper punch 92*a* as shown by the arrows 94 with the sheet metal strip 34*a* therebetween stamps the splined outer periphery 24*a* (FIG. 1*a*) of the metallic clutch disc and, as shown in FIG. 3*a*, forms a burr 94*a* that extends from the outer extremity 24*a* and the axial face 30*a* in the opposite direction along the central axis as the burr 72*a* formed by the inner extremity stamping as previously described. During the stamping of the external extremity, the gas spring 88 allows the lower die insert 86*a* to move downwardly for separation from the sheet metal strip 34*a* and then moves the separated clutch blank upwardly back into the opening of the strip for movement therewith along the advancement direction of the progressive stamping machine.

Figure 3B:
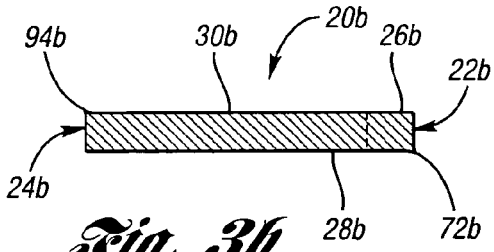

As shown in FIG. 8*b*, the outer extremity stamping station 52 when utilized to stamp the internally splined clutch disc includes a second die set 78*b* having a lower die 80*b* including a continuously round opening 82*b*. An insert 86*b* is supported for vertical movement in the lower die round opening 82*b* and is supported by the gas spring 88 in the same manner previously described in connection with the embodiment of FIG. 8*a*. The second forming die set 78*b* shown in FIG. 8*b* also includes an upper punch 90*b* of a continuously round shape slightly smaller than the lower die opening 82*b*. Vertical movement of the upper punch 90*b* as shown by arrows 94 provides the separation of the clutch disc from the sheet metal strip 34*b* and in doing so forms a burr 94*b* extending from the outer extremity 24*b* and the axial face 30*b* as shown in FIG. 3*b*. During such separation, the insert 86*b* shown in FIG. 8*b* moves downwardly and then moves the separated clutch disc blank back upwardly into the sheet metal strip 34*b* for further advancement.

After stamping of the clutch disc outer extremity so as to have a clutch disc blank at the stamping station 52 shown in FIG. 5, regardless of whether it is of the externally splined type as illustrated in FIG. 6*a* or the internally splined type illustrated in FIG. 6*b*, the sheet metal strip being stamped is moved to the idle station 54 and then to the deburring station 56 where further stamping removes the burrs 72*a* and 94*a* or 72*b* and 94*b* as respectively shown in FIGS. 3*a* and 3*b*. This deburring is performed by a deburring die set 96*a* or 96*b* as respectively shown in FIGS. 9*a*, 10*a* and 9*b*, 10*b*. Each of these deburring die sets 96*a* and 96*b* includes an annular spline shaped deburring punch 98*a* or 98*b* and a flat deburring die 100*a* or 100*b* that remove the burrs 72*a*, 94*a* or 72*b*, 94*b* shown respectively in FIGS. 3*a* and 3*b* so as to provide the finished clutch disc construction as illustrated in FIGS. 1*a* and 4*a* or 1*b* and 4*b*.

Figure 4A:
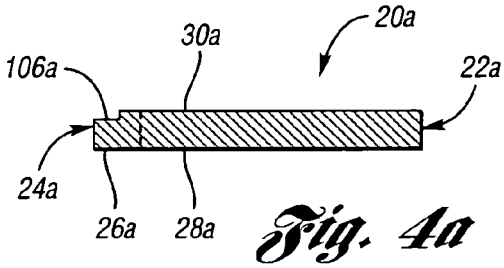
FIGS. 4*a* and 4*b* are respectively sectional views similar to FIGS. 3*a* and 3*b* but showing the two different embodiments of the clutch disc after a stamping deburring operation has removed the burrs with the burr at the splined extremity removed by a decreased thickness peripheral spline formation.
Figure 9A:
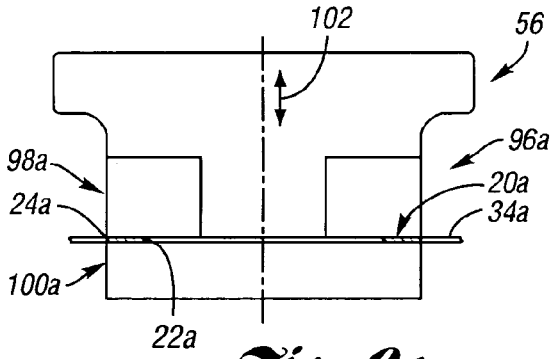
FIGS. 9*a* and 9*b* respectively illustrate the deburring stamping operation of the two clutch disc blanks to provide the finished clutch disc.
Figure 10A:
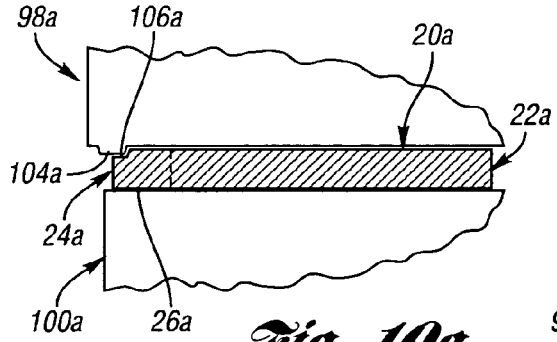
FIGS. 10*a* and 10*b* are enlarged partial views of the left sides of the clutch disc as shown in FIGS. 9*a* and 9*b* but taken at an enlarged scale to better illustrate the manner which the splined clutch disc extremity is deburred.

In the deburring die set embodiment 96*a* shown in FIG. 9*a*, the punch 98*a* is located at an upper position and moved vertically as shown by arrows 102 with the flat deburring die 100*a* located in a lower position below the strip 34*a* that moves the clutch disc blank to the deburring station for the deburring operation. More specifically, the upper deburring punch 98*a* in this embodiment includes a spline shape deburring projection 104*a* of a generally round annular shape that flattens the outer extremity burr 94*a* shown in FIG. 3*a* and decreases the thickness between the axial surfaces 28*a* and 30*a* to form a peripheral spline formation 106*a* best shown in FIGS. 1*a* and 2*a*. The spline shaped deburring projection 104*a* extends outwardly beyond the outer extremity of the clutch disc blank as shown in FIG. 10*a* so as to insure formation of the peripheral spline formation 106*a* even upon misalignment during the deburring stamping. Furthermore, the lower flat deburring die 100*a* removes the inner extremity burr 72*a* shown in FIG. 3*a* so that the finish clutch disc has its inner extremity burr 72*a* shown in FIG. 3*a* flattened as shown in FIG. 4*a*. Thus, the clutch disc 20*a* is progressively stamped in two steps that form burrs in oppositely facing directions, and the burrs are then removed by a further third stamping of the deburring punch and flat deburring die that oppose each other and stamp from opposite directions to complete the clutch disc without any further processing required.

Figure 9B:
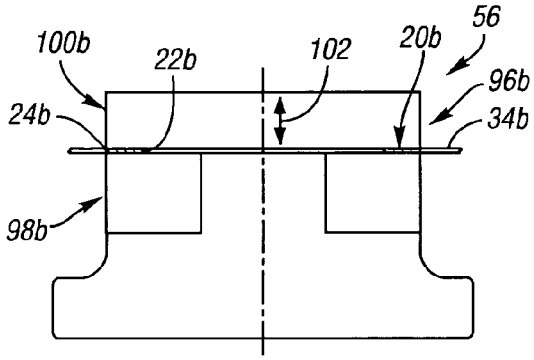
Figure 10B:
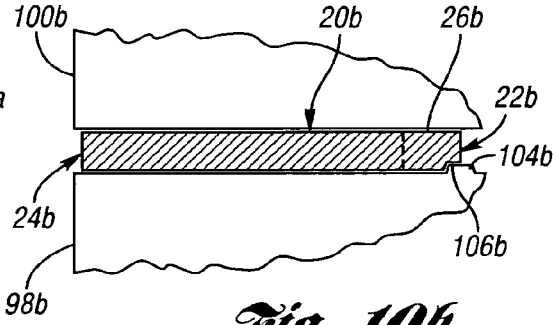

With the inner extremity splined embodiment, the deburring is performed by the deburring die set 98*b* shown in FIG. 9*b* with the annular splined shape deburring punch 98*b* in a lower position below the sheet metal strip 34*b* and with the flat deburring die 100*b* in an upper position above the sheet metal strip. In this construction as shown in FIG. 10*b*, the peripheral spline shaped deburring projection 104*b* is located adjacent the splined inner extremity of the clutch disc blank to remove the burr 72*b* shown in FIG. 3*b* and the upper flat deburring die 100*b* flattens the burr 94*b* shown in FIG. 3*b* so that the finished clutch disc has the configuration shown in FIGS. 1*b* and 4*b* with an annular peripheral spline formation of a decreased thickness between the axial faces 28*b* and 30*b*. This peripheral spline shaped deburring projection 104*b* extends radially inwardly a sufficient extent so as to insure the stamping of the spline formation 106*b* even if there is any misalignment during the deburring stamping. Thus, the clutch disc 20*b* like the clutch disc 34*a* is also progressively stamped in two steps that form burrs in oppositely facing directions, and the burrs are then removed by a further third stamping of the debarring punch and flat deburring die that oppose each other and stamp from opposite directions to complete the clutch disc without any further processing required.

Figure 4B:
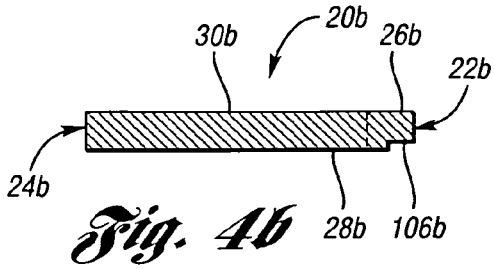

The peripheral spline shaped deburring projection 104*a* or 104*b* that flattens the burr 94*a* or 72*b* extending from the splined extremity 24*a* or 22*b* of the clutch disc blank provides the peripheral spline formation with a thickness between about 5 and 20% thinner than the thickness between the oppositely facing axial surfaces 28*a*, 28*b* or 30*a*, 30*b* of the clutch disc blank before the deburring. By providing the spline shaped deburring with the peripheral spline formation 106*a* or 106*b*, the deburring can be performed with less stamping pressure while still insuring removal of the burrs. Furthermore, the peripheral spline formation 106*a* or 106*b* extends inwardly from the extremity thereof an amount in the range of 0.010 to 0.060 of an inch which is an amount dependent upon clutch disc diameter, alignment tolerances and spline size, etc. Regardless of whether the peripheral spline formation is formed on the outer extremity as shown in FIGS. 1*a*, 2*a* and 4*a* or the inner extremity as shown in FIGS. 1*b*, 2*b* or 4*b*, the peripheral spline formation 106*a* or 106*b* decreases the thickness on the tip of each spline and each spline face as well as the spline root extending between the adjacent splines so that removal of the burr is complete without requiring excessive press pressure during the deburring since a central portion of each spline is not stamped and remains with the original thickness between the axial faces. Each embodiment of the stamping 20*a* and 20*b* as respectively shown in FIGS. 1*a*, 2*a*, 3*a*, 4*a* and 1*b*, 2*b*, 3*b*, 4*b* has a uniform thickness between its oppositely facing axial surfaces 28*a*, 30*a* and 28*b*, 30*b* except for the decreased thickness at the peripheral spline formation 106*a* and 106*b*.

While the preferred embodiments and modes for practicing the invention have been described in detail, those familiar with the art to which this invention relates will recognize alternative ways of practicing the invention as defined by the following claims.

What is claimed is:

1. Apparatus for progressively stamping a metallic clutch disc from a sheet metal strip, comprising:

progressive stamping stations for stamping a blank of the metallic clutch disc from the sheet metal strip so as to have a generally annular shape extending around a central axis and including oppositely oriented axial faces and inner and outer extremities, with one of the extremities having splines forming a generally round shape about the central axis and including a first burr extending therefrom and from one of the axial faces in one axial direction along the central axis, and with the other extremity having a generally continuous round shape about the central axis and including a second burr extending therefrom and from the other axial face in the opposite axial direction as the first burr along the central axis; and a deburring station including a deburring die set having an annular spline shaped deburring punch and a flat deburring die between which the clutch disc blank is positioned for relative movement of the deburring punch and the deburring die toward each other, the spline shaped deburring punch having a peripheral spline shaped deburring projection that flattens the first burr extending from the one spline shaped extremity and the one axial face, and the flat deburring die flattening the second burr extending from the other extremity and the other axial face.

2. Apparatus for progressively stamping a metallic clutch disc as in claim 1 wherein the progressive stamping stations includes:

a first forming die set including a generally round forming die and a forming punch for removing a round blank from the clutch disc being stamped to provide the inner extremity of the clutch disc blank;

a second forming die set including a forming die and a forming punch for separating the clutch disc blank from the sheet metal strip to provide a round outer extremity of the clutch disc blank; and the forming die and forming punch of one of the forming die sets having annular spline formations for providing the extremity formed thereby with the splines.

3. Apparatus for progressively stamping a metallic clutch disc as in claim 2 wherein the wherein:

the forming punch and forming die of the first forming die set are round and form the inner extremity of the clutch disc blank with the generally continuous round shape; and the forming punch and forming die of the second die set have the annular spline formations for providing the outer extremity of the clutch blank with the splines.

4. Apparatus for progressively stamping a metallic clutch disc as in claim 2 wherein the wherein:

the forming punch and forming die of the first forming die set have the annular spline formations for providing the inner extremity of the clutch disc blank with the splines; and the forming punch and forming die of the second die set are round and provide the outer extremity of the clutch blank with the generally continuous round shape.

5. Apparatus for progressively stamping a metallic clutch disc as in claim 1 wherein the peripheral spline shaped deburring projection of the deburring punch projects a sufficient extent to both flatten the first burr and decrease the thickness between the axial faces with a peripheral spline formation.

6. Apparatus for progressively stamping a metallic clutch disc as in claim 5 wherein the peripheral spline formation has a thickness between about 5 and 20% thinner than the thickness between the oppositely facing axial faces of the clutch disc blank before the deburring.

7. Apparatus for progressively stamping a metallic clutch disc as in claim 5 wherein the peripheral spline formation extends inwardly from the extremity thereof an amount in the range of 0.010 to 0.060 of an inch.

8. Apparatus for progressively stamping a metallic clutch disc as in claim 5 wherein the peripheral spline formation has a thickness between about 5 and 20% thinner than the thickness between the oppositely facing axial faces of the clutch disc blank before the deburring;

and wherein the peripheral spline formation extends inwardly from the extremity thereof an amount in the range of 0.010 to 0.060 of an inch.

9. Apparatus for progressively stamping a metallic clutch disc from a sheet metal strip, comprising:

a first forming station including a first forming die set having a forming punch and a forming die for removing a round blank from the sheet metal strip to provide an inner extremity of the clutch disc to being stamped, with the inner extremity having a generally round shape extending around a central axis and with the sheet metal strip having oppositely oriented axial faces and with the inner extremity including a first burr extending therefrom and from one of the axial faces in one axial direction along the central axis;

a second forming station including a second forming die set having a forming punch and a forming die for separating the clutch disc from the sheet metal strip to provide a round outer extremity of the clutch disc with the other extremity having a generally continuous round shape about the central axis and including a second burr extending therefrom and from the other axial face in the opposite axial direction as the first burr along the central axis;

the forming die and forming punch of the forming die set of one of the forming stations having annular spline formations for providing the extremity formed thereby with splines;

a deburring station including a deburring die set having an annular spline shaped deburring punch and a flat deburring die between which the clutch disc blank is positioned for relative movement of the deburring punch and the deburring die toward each other, the spline shaped deburring punch having a peripheral spline shaped deburring projection that flattens the burr extending from the one spline shaped extremity and the one axial face, and the flat deburring die flattening the other burr extending from the other extremity and the other axial face; and the annular spline shaped deburring punch having its spline shaped deburring projection for forming a peripheral spline formation with a thickness that is in the range of 5 to 20% less than the thickness between the rest of the axial faces, and with the peripheral spline formation extending inwardly from the extremity thereof an amount in the range of 0.010 to 0.060 of an inch.

10. A method for progressively stamping a metallic clutch disc from a sheet metal strip, comprising:

progressively stamping a blank of the metallic clutch disc from the sheet metal strip so as to have a generally annular shape extending around a central axis and including oppositely oriented axial faces and inner and outer extremities, with one of the extremities having splines forming a generally round shape about the central axis and including a first burr extending therefrom and from one of the axial faces in one axial direction along the central axis, and with the other extremity having a generally continuous round shape about the central axis and including a second burr extending therefrom and from the other axial face in the opposite axial direction as the first burr along the central axis; and positioning the clutch disc blank at a deburring station within a deburring die set between an annular spline shaped deburring punch and a flat deburring die for relative movement of the deburring punch and the deburring die toward each other so a peripheral spline shaped deburring projection of the spline shaped deburring punch flattens the first burr extending from the one spline shaped extremity and the one axial face and forms a peripheral spline formation and so the flat deburring die flattens the second burr extending from the other extremity and the other axial face.

11. A method for progressively stamping a metallic clutch disc as in claim 10 wherein;

a forming punch of a first forming die set is initially moved toward a forming die thereof to remove a round blank from the clutch disc being stamped to provide the inner extremity of the clutch disc blank;

a forming punch of a second forming die set is moved toward a forming die thereof to separate the clutch disc blank from the sheet metal strip; and the forming punch and forming die of one of the die sets used having annular spline formations for providing the extremity formed thereby with the splines.

12. A method for progressively stamping a metallic clutch disc as in claim 11 wherein:

the forming punch and forming die of the first forming die set form the inner extremity of the clutch disc blank with the generally continuous round shape; and the forming punch and forming die of the second die set form the outer extremity of the clutch blank with the splines.

13. A method for progressively stamping a metallic clutch disc as in claim 11 wherein:

the forming punch and forming die of the first forming die set form the inner extremity of the clutch disc blank with the splines; and the forming punch and forming die of the second die set form the outer extremity of the clutch blank with the generally continuous round shape.

14. A method for progressively stamping a metallic clutch disc as in claim 10 wherein the spline shaped deburring punch and the flat deburring die of the deburring die set flatten the first burr and decrease the thickness between the axial faces at the peripheral spline formation.

15. A method for progressively stamping a metallic clutch disc as in claim 14 wherein the spline shaped deburring punch and the flat deburring die of the deburring die set flatten the first burr and decrease the thickness between the axial faces at the peripheral spline formation with a thickness that is between about 5 and 20% thinner than the thickness between the rest of the oppositely facing axial faces of the clutch disc blank.

16. A method for progressively stamping a metallic clutch disc as in claim 10 wherein the spline shaped deburring punch and the flat deburring die of the deburring die set flatten the first burr and decrease the thickness between the axial faces with the peripheral spline formation extending inwardly from the extremity thereof an amount in the range of 0.010 to 0.060 of an inch.

17. A method for progressively stamping a metallic clutch disc as in claim 10 wherein the spline shaped deburring punch and the flat deburring die of the deburring die set:

flatten the first burr and decrease the thickness between the axial faces at the peripheral spline formation whose thickness is between about 5 and 20% thinner than the thickness between the rest of the oppositely facing axial faces of the clutch disc blank; and form the peripheral spline formation extending inwardly from the extremity thereof an amount in the range of 0.010 to 0.060 of an inch.

18. A method for progressively stamping a metallic clutch disc from a sheet metal strip, comprising:

a first forming punch of a first forming die set and a forming die thereof are moved toward each other with the sheet metal strip therebetween to removing a round blank from the sheet metal strip and provide an inner extremity of the clutch disc to being stamped, with the inner extremity having a generally round shape extending around a central axis and with the sheet metal strip having oppositely oriented axial faces and with the inner extremity including a first burr extending therefrom and from one of the axial faces in one axial direction along the central axis;

a second forming punch of a second forming die set and a forming die thereof are moved toward each other to separating a clutch disc blank from the sheet metal strip and provide an outer extremity of the clutch disc blank with a second burr extending therefrom and from the other axial face in the opposite axial direction as the first burr along the central axis;

the forming punch and forming die of one of the forming die sets forming the extremity provided thereby with splines;

positioning the clutch disc blank at a deburring station within a deburring die set between an annular spline shaped deburring punch and a flat deburring die for relative movement of the deburring punch and the deburring die toward each other, with the spline shaped deburring punch flattening the burr extending from the one spine shaped extremity and the associated axial face, and with the flat deburring die flattening the other burr extending from the other extremity and the associated axial face; and the spline shaped deburring punch and the flat deburring die of the deburring die set: flattening the one burr and decreasing the thickness between the axial faces with an annular spline formation whose thickness is between about 5 and 20% thinner than the thickness between the rest of the oppositely facing axial faces of the clutch disc blank; and forming the peripheral spline formation extending inwardly from the extremity thereof an amount in the range of 0.010 to 0.060 of an inch.

* * * * *